US006426698B1

(12) United States Patent
Frisa et al.

(10) Patent No.: US 6,426,698 B1
(45) Date of Patent: Jul. 30, 2002

(54) LOT SIGNALLING DEVICE

(75) Inventors: Larry Edward Frisa; Clinton Haris; Mark Hiatt, all of Dresden (DE)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/573,949

(22) Filed: May 19, 2000

(51) Int. Cl.[7] ..... G08B 1/08; G08B 5/22

(52) U.S. Cl. ..... 340/539; 340/825.49; 340/825.69; 438/14

(58) Field of Search ..... 340/539, 825.49, 340/825.69, 825.72; 438/5, 14

(56) References Cited

U.S. PATENT DOCUMENTS 4,101,873 A * 7/1978 Anderson et al. ..... 340/539
4,476,469 A * 10/1984 Lander ..... 340/539
5,565,858 A * 10/1996 Guthrie ..... 340/825.49
5,952,918 A * 9/1999 Ohayon ..... 340/539
6,046,682 A * 4/2000 Zimmerman et al. .. 340/825.49

* cited by examiner

*Primary Examiner*—Donnie L. Crosland
(74) *Attorney, Agent, or Firm*—Robert L. King

(57) ABSTRACT

An apparatus related to a lot signalling device used to find misplaced lots. A remote control signalling device comprises a receiver section (5) for receiving an RF-command including a unique address of at least one of said plurality of remote control signalling devices (3) from a central control unit (1), an address memory (6) for storing the address of said remote control signalling device, an output section (7) for signalling an alarm upon receiving the RF-command, if said address included in the RF-command matches the stored address in said address memory (6). A method for processing items at different process stages comprises the steps of: transmitting RF-commands including a unique address of at least one of said plurality of remote control signalling devices by a central control unit (1), signalling an alarm by said remote control signalling device (3) upon reception of an RF-command from said central control unit (1).

11 Claims, 2 Drawing Sheets

LOT SIGNALLING DEVICE

FIELD OF INVENTION

The invention is related to a lot signalling device used to find misplaced lots.

BACKGROUND

During the course of processing lots in a pilot line or production factory a lot will be misplaced and will not be available for processing. Additionally, if a lot has been misplaced and forgotten, it might not be processed in a timely manner.

Therefore, tags have been proposed in the prior art, which are attached to the lots. On these tags information about the concerned lot is entered, such as lot number and last and next process steps. With a tag on it a lot can thus unambiguously be identified and handling the lot is made easier for the personnel in a factory, since the immediately preceding and following process steps are indicated on the tag.

However, the data on the tag must be entered and updated by hand and only a relatively limited amount of information is accepted on the tag. Further, the tag is placed with the lot so that it does not help very much in case the lot is misplaced and is not to be found. Only when a misplaced lot is eventually found, it can be identified by the prior art tag on it and reentered into the process again.

Thus, there is a need for a device that prevents lots from getting lost in a production factory between separate process steps.

BRIEF DESCRIPTION OF THE DRAWINGS

The invention provides for a method and a remote control signalling device comprising a beeper or a light source on each lot and a clean room.

The basic principle of the invention is that, when a lot is desired to be located, a wireless radio command is sent out which activates the lot's signalling device so it can be found. Thus, the method according to the invention for processing items at different process stages, comprising the steps of loading said items into one of a plurality of lot boxes, transporting said lot box from a first to a second of said process stages, and unloading said lot box at said second process stage, wherein each of said plurality of lot boxes is furnished with a remote control signalling device, comprises further the steps of: transmitting RF-commands including a unique address of at least one of said plurality of remote control signalling devices by a central control unit, signalling an alarm by said remote control signalling device upon reception of an RF-command from said central control unit.

As a further aspect of the invention a remote control signalling device being attachable to a lot box comprises a receiver section for receiving an RF-command including a unique address of at least one of a plurality of remote control signalling devices from a central control unit, an address memory for storing the address of said remote control signalling device, an output section for signalling an alarm upon receiving the RF-command, if said address included in the RF-command matches the stored address in said address memory.

As still a further aspect of the invention a clean room having different process stages for processing of items, comprising a plurality of lot boxes for transporting said items between said different process stages, wherein each of said lot boxes is equipped with a remote control signalling device, comprises a central control unit for transmitting RF-commands including a unique address of at least one of said plurality of remote control signalling devices so as to signal an alarm by said addressed remote control signalling device.

As an advantage of the invention any factory with different process stages and transportation of lots of items between them can easily be upgraded with a remote control system according to the invention.

Figure 1:
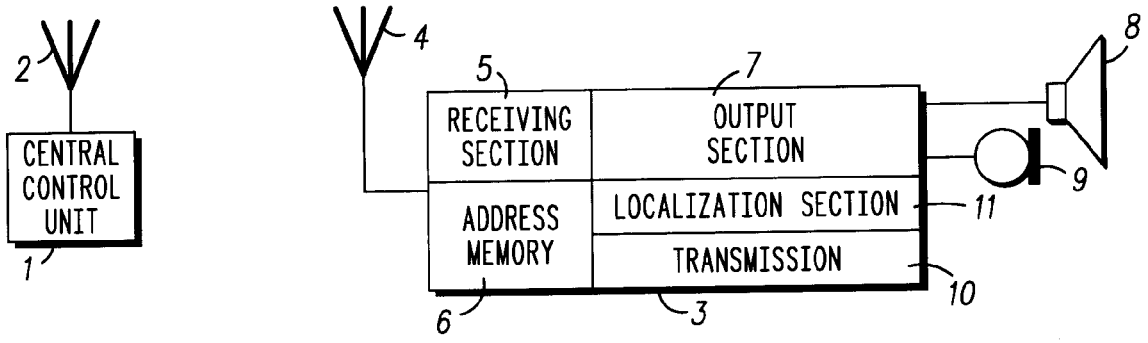

FIG. 1 shows a central control unit and a schematic view of a remote control signalling device according to the invention.

Figure 2:
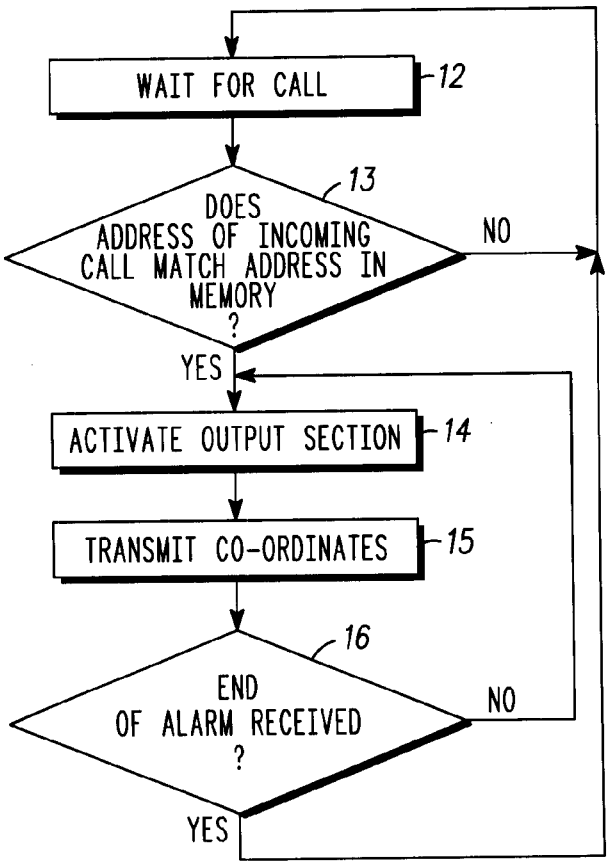

FIG. 2 shows a flow chart of the procedure carried out by the remote control signalling device according to the invention.

Figure 3:
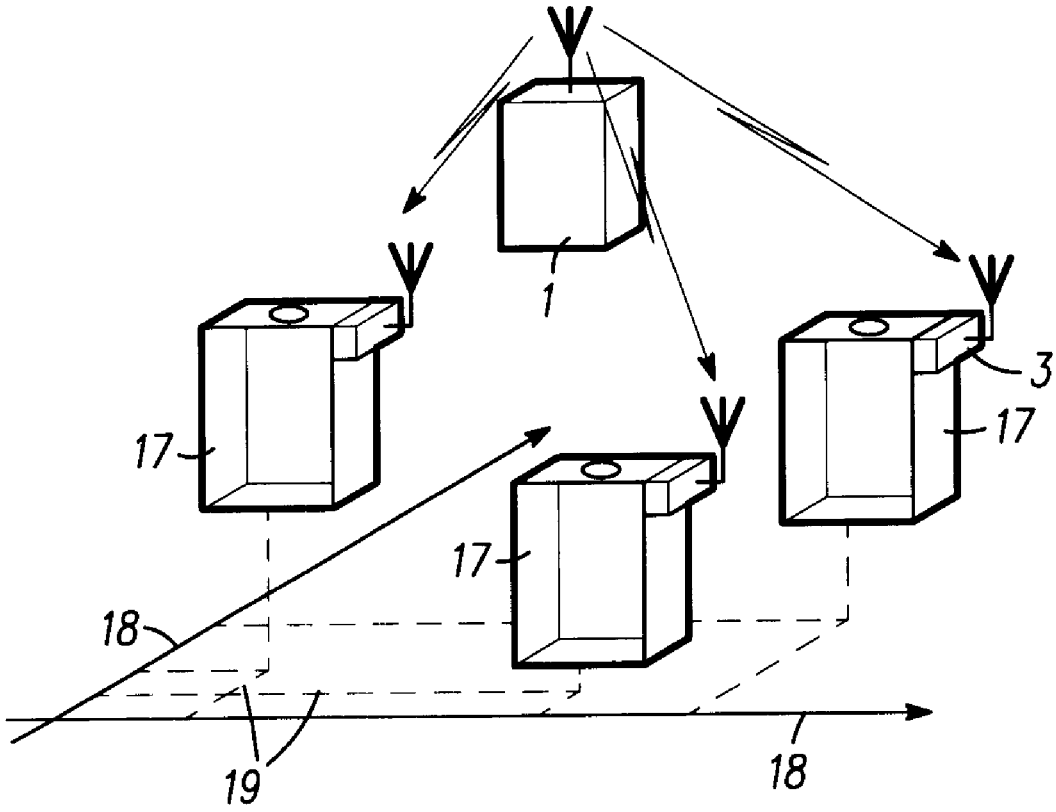

FIG. 3 shows a schematic view of the constituents of a clean room according to the invention.

DETAILED DESCRIPTION

In FIG. 1 a central control unit 1 is shown which is devised to contact and to command remote control signalling devices 3 which are each attached to a lot box (not shown). The remote control signalling devices 3 provides the possibility of signalling an audible, a visible, and a wireless alarm so as to identify the current position of the lot in the factory, when a lot box has been misplaced and a user or owner of said lot box needs to trace the lot box for its further processing. The RF-commands from the central control unit 1 and—optional—reception acknowledge signals from the remote control signalling devices 3 are exchanged via an antenna 2 on the side of the central control unit 1 and an antenna 4 on the side of the remote control signalling device 3, respectively.

In the following the invention will be explained with reference to a semiconductor factory, where several semiconductor wafers form a lot and FOUPs (front open unified pods) are used as lot boxes. However, the invention is not limited to a semiconductor factory but is applicable in other fields as well.

The main components of the remote control signalling device 3 are shown in FIG. 1. In the embodiment of FIG. 1 the remote control signalling device 3 comprises a receiving section 5 for receiving messages from the central control unit 1. Thus any lot box can be reached by the central control unit 1 anywhere within the reach of the central control unit transmitter (not shown). However, normally only a particular lot is searched for and only one remote control signalling device 3 is to be activated. In order to enable a selective call of such a particular device 3 each device comprises an address memory 6. In the address memory 6 an address is stored which is unique for each of a plurality of remote control signalling devices 3, that is the address is an identifier of the remote control signalling device 3. In the RF-command which is transmitted by the central control unit 1 an address is included which identifies the particular device 3 on the lot box which is to be traced. When the remote control signalling device 3 receives an RF-command it verifies that the received address matches the address in the address memory 6. If so, an output section 7 for signalling an alarm is activated. The output section 7 may comprise or be linked to several signalling means. In the embodiment of FIG. 1 the output section 7 is linked to a beeper 8. By the beeper 8 an audible alarm can be signalled. However, in a noisy environment such an audible alarm may prove not to be sufficient. In order to enhance the perceptibility of the alarm in a noisy environment an additional or alternative means such as a (pulsating) light source, e.g. a flash light 9 is provided. Thus, due to the audible/visible alarm of the remote control signalling device 3 attached to the lot box the missing lot box may easily be found by the personnel in the factory. Further, also a wireless "alarm" may be triggered off upon reception of an RF-command. This is especially convenient when information about the missing lot box can be returned to the central control unit 1, e.g. the latest process step which has been undergone by the lot box as well as its due process step. Therefore, the embodiment of the remote control signalling device 3 in FIG. 1 also comprises a transmitter section 10 in addition to the beeper 8 and the flash light 9.

Under certain circumstances information about the latest and a due process step may not be sufficient either to localise a misplaced lot. Hence, the remote control system, which the central unit 1 and the signalling device 3 are part of, comprises a reference system in a preferred embodiment of the invention. In such system an optional localisation section 11 is provided in the signalling device 3. The localisation section 11 determines the current co-ordinates of the lot box in said reference system and transmits them via said transmitter section 10 to the central control unit 1. Thus, the lot box can be directly found. The reference system may be based for example on pulsed optical signal sources or wireless RF-signal sources receivable in each storage room for lot boxes only which are distinguished e.g. by their different pulse frequencies. Even a GPS-link of the signalling devices 3 with a spatial resolution of 3 m to 10 m is conceivable.

The method for processing items at different process stages, e.g. in a clean room of a semiconductor factory comprises loading said items into one of a plurality of lot boxes, so that they can be collectively transported as a lot to a next process stage. The lot box is then brought from a first to a second process stage. At its destination stage the lot box is unloaded. Each of the plurality of lot boxes is furnished with a remote control signalling device 3 according to FIG. 1.

The procedure which is carried out by the signalling device 3 in a remote control system is shown as a flow chart in FIG. 2. RF-commands including a unique address of at least one of a plurality of remote control signalling devices 3 are transmitted by the central control unit 1. Upon reception of an RF-command from said central control unit 1 an alarm is issued by said remote control signalling device 3. Hence, most of the time the remote control signalling device 3 will be in a state waiting for a call, step 12. If a call from the central unit 1 has been received the address included in the call is verified in step 13. If the address does not match the own address, i.e. the address in the local address memory 6, the signalling device 3 returns to its waiting state in step 12. If, however, the received address matches the stored address in memory 6 the procedure branches to step 14, activation of the output section 7 which is linked to at least one of a beeper 8, a flash light 9, and a transmitter section 10 for returning information from the signalling device 3 to the central control unit 1. The transmission of said information is performed in step 15 of the procedure.

Preferably the alarm will break off after a predetermined period of time. However, also the duration of the alarm may be subject to remote control. In this case the central control unit 1 sends a signal "end of alarm" to the signalling device 3 when there is no need for an audible or visible localisation aid any more, e.g. the lot has been found (in this case the "end of alarm" may be released by a simple switch on the signalling device, too) or it was confirmed by the transmission of the co-ordinates that the lot is at its proper position in the process.

The reception of an "end of alarm" signal will be polled at regular time intervals, step 16. If an "end of alarm" signal has not yet been received the procedure returns to step 14, 15, namely activation of the output section 7 and—optional—transmission of co-ordinates. If, however, an "end of alarm" signal has been received the procedure returns to its waiting state 12 again.

In FIG. 3 a clean room in a semiconductor factory is shown, in which clean room different process stages are provided for processing e.g. semiconductor wafers. For transporting said semiconductor wafers between said different process stages a plurality of FOUPs (lot boxes) is provided. Each of these FOUPs is equipped with a remote control signalling device 3 according to FIG. 1. In said clean room or in its neighbourhood there is a central control unit 1 for transmitting RF-commands to at least one of said plurality of remote control signalling devices 3. The RF-command includes a unique address of a particular signalling device 3. As explained with reference to FIG. 2 the signalling device 3 signals an alarm, if said address in the RF-command matches the address in the memory 6. Otherwise it returns to its waiting state so that only the addressed signalling device 3 will issue an alarm whereas the other devices 3 remain silent.

Although the invention has been described so far with a central control unit 1 capable of signalling many lots, it is clear that the RF-command can also be sent out by a small hand held device—optionally with limited reach so that only lots in a confined area are addressed.

If the clean room comprises a reference system 18 a lot box could unambiguously be locatable. Such a clean room with a reference system is shown in FIG. 3. There is a central control unit 1 for contacting missing lots 17, each being equipped with a remote control signalling device 3. In general a single co-ordinate 19 representing the position of a lot box in a process line would suffice to let a FOUP be found in such factory based reference system. Yet, if the clean room accommodates several process lines with branching points between them at which the lots could be misplaced a second co-ordinate 18 would be necessary so as to define the position of a FOUP in a plane. Such two-dimensional reference system is depicted in FIG. 3. As mentioned above such two-dimensional system could be GPS-linked, whereas with a single line clean room simpler arrangements are conceivable.

In addition to the transmission of the latest process step and the next process step to the central control unit 1 the remote control signalling device 3 may further comprise a clock means for determining a dwell time between a completed process step and a due process step and a dwell time memory for storing at least one dwell time which is acceptable between subsequent process steps. A comparator compares the dwell time as determined by the clock means then with the dwell time as stored in the dwell time memory. If the comparison result shows that the determined dwell time is greater than the stored dwell time the remote control signalling device 3 signals automatically an alarm and—optionally transmits its co-ordinates in said reference system to the central control unit 1.

The invention is clearly not limited to the above embodiments. Instead, the remote control signalling unit according to the invention which is attached to each FOUP (or lot box) can also be used for other "smart signalling" purposes such as:

sending a confirmation signal back to the central control unit to verify the lot has received the signalling command an others;

programming it to signal (beep and/or flash) so that a queue time is not missed (i.e. the time between a wet, clean and deposition step);

programming it to signal when the FOUP/lot box is needed to be cleaned (this can be done by either time since the last cleaning or the number of process steps since the last cleaning);

signalling (alarming) with different colour lights when the FOUP/lot is placed on the correct or incorrect process equipment for processing (this would reduce mis-processing and scrap);

storing information to transfer from one step to another (i.e. SPC or pre-measurement data);

paging engineers or lot owners when the lot has reached a certain step.

In other words, as a further convenient feature of the remote control signalling device 3, it can be programmed to activate if the lot has not been processed within a predetermined time, thus preventing misplaced lots form being forgotten.

Reference Numerals

1 central control unit

2 antenna of central control unit

3 remote control signalling device

4 antenna of remote control signalling device

5 receiver section

6 address memory

7 output section

8 beeper

9 flash light

10 transmitter section of remote control signalling device

11 localisation section

12 wait for a call

13 branching/returning if RF-command address unequal to own address

14 activating output section

15 transmission of co-ordinates

16 branching/returning if "end of alarm" received

17 lot box

18 reference system

19 co-ordinate

What is claimed is:

1. A method for processing items at different process stages, comprising the steps of loading said items into one of a plurality of lot boxes, transporting said one of the plurality of lot boxes from a first to a second of said process stages, and unloading said one of the plurality of lot boxes at said second process stage, wherein each of said plurality of lot boxes is furnished with one of a remote control signalling device from a plurality of remote control signaling devices, said method further comprising the steps of:

transmitting RF-commands including a unique address of at least one of said plurality of remote control signalling devices by a central control unit to program said one of the plurality of lot boxes to detect a predetermined point in time, and upon detecting the predetermined point in time, signalling an alarm by said remote control signalling device corresponding to the unique address.

2. The method of claim 1, wherein the items comprise semiconductor wafers and said lot box is a front open unified pod (FOUP).

3. A remote control signalling device being attachable to a lot box, comprising:

a receiver section for receiving an RF-command from a control unit, the RF command including a unique address assigned to the remote control signalling device, the RF-command programming the remote control signaling device to detect occurrence of a predetermined manufacturing event for product associated with the lot box;

an address memory for storing the address of said remote control signalling device; and an output section for signalling an alarm upon receiving the RF-command, if said address included in the RF-command matches the stored address in said address memory.

4. The remote control signalling device as set forth in claim 3, comprising a beeper so as to signal an audible alarm.

5. The remote control signalling device as set forth in claim 3, comprising a flash light so as to signal a visible alarm.

6. The remote control signalling device as set forth in claim 3, comprising a beeper and a flash light so as to signal an audible and a visible alarm.

7. The remote control signalling device as set forth in claim 3, comprising:

a localisation section for determining a current co-ordinate of the lot box in a reference system and a transmitter section for transmitting said co-ordinate to the control unit.

8. A clean room having different process stages for processing items, comprising a plurality of lot boxes for transporting said items between said different process stages, wherein each of said lot boxes is equipped with a remote control signalling device, said clean room comprising a central control unit for transmitting RF-commands including a unique address of at least one of said plurality of remote control signalling devices so as to program the at least one of said plurality of remote control signaling devices to signal an alarm by the addressed remote control signalling device upon determining a lapse of time between two processing steps required for processing the items.

9. The clean room as set forth in claim 8, further comprising a reference system in which a lot box is unambiguously locatable.

10. The clean room as set forth in claim 9, wherein said reference system is a factory based reference system and includes a single co-ordinate representing the position of a lot box in a process line.

11. The clean room as set forth in claim 9, wherein said reference system is a factory based reference system and includes two coordinates representing the position of a lot box in a plane.

* * * * *